US005299518A

United States Patent [19]

Dusch et al.

[11] Patent Number: 5,299,518

[45] Date of Patent: Apr. 5, 1994

[54] LOWER FEED DOG LIFTING, LOWERING, AND HORIZONTAL COUPLING

[75] Inventors: Albert Dusch, Kaiserslautern; Karl-Heinz Walther, Weilerbach, both of Fed. Rep. of Germany

[73] Assignee: Pfaff Industriemaschinen GmbH, Kaiserlautern, Fed. Rep. of Germany

[21] Appl. No.: 623,371

[22] PCT Filed: Apr. 26, 1989

[86] PCT No.: PCT/EP89/00453

§ 371 Date: Jan. 2, 1991

§ 102(e) Date: Jan. 2, 1991

[87] PCT Pub. No.: WO89/12127

PCT Pub. Date: Dec. 14, 1989

[30] Foreign Application Priority Data

Jun. 4, 1988 [DE] Fed. Rep. of Germany ..... 3819061

[51] Int. Cl.[5] ..... D05B 27/24

[52] U.S. Cl. ..... 112/323

[58] Field of Search ..... 112/220, 284, 319, 323, 112/459, 460

[56] References Cited

U.S. PATENT DOCUMENTS

| | | | |
|---|---|---|---|
| 2,496,817 | 2/1950 | Schulthess | 112/210 |
| 2,526,480 | 10/1950 | Hohmann | 112/323 |
| 2,713,839 | 7/1955 | Engel | 112/323 |
| 4,391,216 | 7/1983 | Hsiao | 112/323 X |
| 4,559,887 | 12/1985 | Sand | 112/459 X |
| 4,756,263 | 7/1988 | Sand | 112/323 X |

FOREIGN PATENT DOCUMENTS

| | | | |
|---|---|---|---|
| 0225185 | 12/1909 | Fed. Rep. of Germany . | |
| 0926213 | 9/1947 | France . | |
| 0183578 | 8/1966 | U.S.S.R. | 112/323 |

*Primary Examiner*—Clifford D. Crowder
*Assistant Examiner*—Ismael Izaguirre
*Attorney, Agent, or Firm*—McGlew and Tuttle

[57] ABSTRACT

Sewing machine with a lower feed dog, to which adjustable horizontal pushing motions are imparted by a driving cam via a stitch length regulating mechanism and vertical lifting movements are imparted by a driving cam via a lifting shaft. A lifting crank, with the free end of a follower mounted pivotably, can be swiveled out, in one position intended for sewing with a skipping feed into a slot of an oscillating crank mounted freely pivotably on the lifting shaft at a laterally spaced location from the lifting crank. In another position the follower is mounted into a slot of a holder, which is a rigid part of the housing and is arranged at a laterally spaced location from the lifting crank for bordering fabric edges with a band strip, fed in folded in the shape of a U around the fabric edges by a band strip bordering apparatus which participates in the horizontal feed motions of the feed dog.

9 Claims, 1 Drawing Sheet

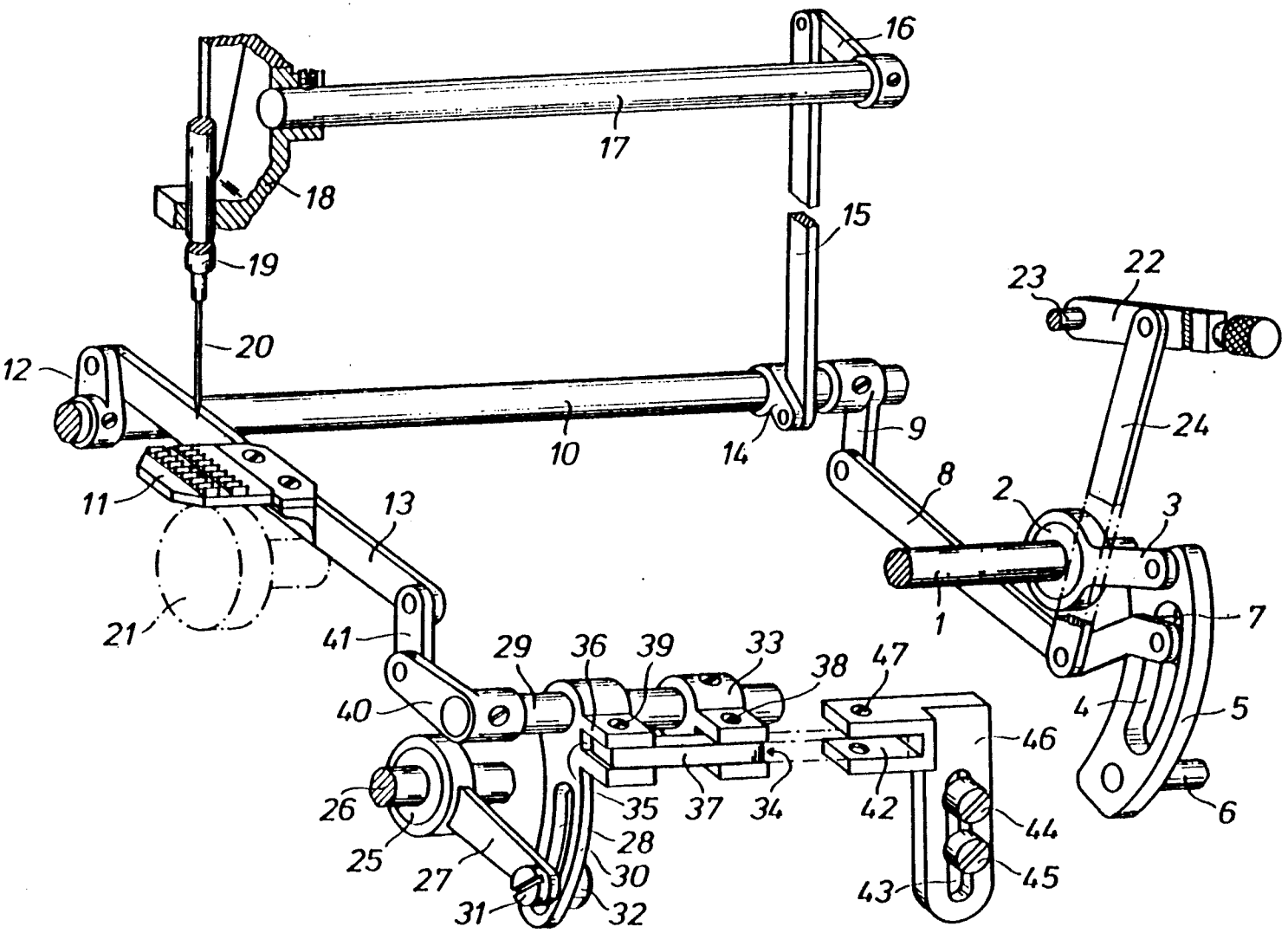
1
2
3
4
5
6
7
8
9
10
11
12
13
14
15
16
17
18
19
20
21
22
23
24
25
26
27
28
29
30
31
32
33
34
35
36
37
38
39
40
41
42
43
44
45
46
47

LOWER FEED DOG LIFTING, LOWERING, AND HORIZONTAL COUPLING

BACKGROUND OF THE INVENTION

1. Field of the Invention

The present invention pertains in general to a sewing machine with a lower feed dog movable in vertical and horizontal directions and in particular to a sewing machine where the lower feed dog can move either horizontally and vertically, or only horizontally.

2. Background Art

A sewing machine of this design has been known from West German Patent Specification No. DE-PS 21,08,309 and its parallel U.S. Pat. No. 3742880. It has a combined feed device, which consists of a lower feed dog and a needle feed device, in which an oscillating shaft controlling a needle bar oscillating frame is connected to an oscillating shaft moving a feed dog holder to and fro in a horizontal plane. The oscillating movements of the oscillating shaft are derived from a feed cam and the amplitude of these movements can be adjusted by means of a stitch length regulating device. Besides the horizontal reciprocating movements, vertical lifting movements are imparted to the lower feed dog by a driving cam via a cam rod and a crank mechanism, so that the lower feed dog performs a tetragonal movement. This combined feed device guarantees the displacement-free sewing together of a plurality of fabric layers.

A band strip bordering apparatus participates in the horizontal movements of the feed dog, and folds a bond strip in the shape of a U around the edges of the fabric. When fabric edges are bordered with a band strip, which is fed in and sewn on, the lower feed dog must not perform any vertical movements. In this machine, the lifting drive mechanism, the driving cam, and the cam rod must be removed. This takes very much time, when the sewing machine is to be used for bordering operations with the attached band strip bordering apparatus. For use in normal sewing operations, it is necessary to reinstall the lifting drive mechanism.

As an alternative, it is possible to use a second sewing machine in which only horizontal pushing movements, but no vertical lifting movements, are imparted to the lower feed dog. Such a sewing machine has been known from West German Offenlegungsschrift No. DE-OS 18,09,0979 and its parallel U.S. Pat. No. 3467039. However, this sewing machine is suitable only for certain sewing operations.

From FR-A-926 213 the insertion of a coupler in the hoist drive of the material slider of a sewing machine for the neutralization of the vertical motion of the material slider is known. However, the printed material does not indicate for which purpose this should be used.

SUMMARY AND OBJECTS OF THE INVENTION

It is an object of the present invention to design a sewing machine with a lower feed dog having adjustable horizontal pushing motions imparted to it by a driving cam via a stitch length regulating mechanism. The lower feed dog can also have optional vertical lifting movements imparted to it by a driving cam via a lifting shaft. Thus the feed dog is able to optionally perform either tetragonal movements or only horizontal pushing movements.

This task is accomplished by a removable connection between the driving cam and the lifting shaft. When vertical movements of the feed dog are desired, an oscillating crank, oscillated by the driving cam, is rigidly fastened to the lifting shaft by a follower and a lifting crank. When vertical movements are not desired the follower is removed from the oscillating crank and movements of the oscillating crank then no longer effect the lifting shaft. The follower is then firmly attached to a housing of the sewing machine in order to keep the lifting shaft from moving.

Although the oscillating crank is mounted on the lifting shaft, it is rotatably mounted and therefore will have no effect on the lifting shaft when it is not connected to the lifting crank by the follower.

An adjustable holder for the follower makes it possible to adjust the height of the feed dog when the lifting movement is turned off, on one hand, and, on the other hand, it is also simple and easy to align the slots of the holder and of the crank on the lifting shaft with each other in order to use the follower.

A slot in the oscillating crank where it is indirectly fastened to the driving cam makes it possible to change the amplitude of the lifting movement of the lower feed dog and to adapt it to different fabrics. For example, in case of thin fabrics, a smaller lifting movement of the lower feed dog makes it possible to increase the machine speed.

The various features of novelty which characterize the invention are pointed out with particularity in the claims annexed to and forming a part of this disclosure. For a better understanding of the invention, its operating advantages and specific objects attained by its uses, reference is made to the accompanying drawing and descriptive matter in which a preferred embodiment of the invention is illustrated.

BRIEF DESCRIPTION OF THE DRAWINGS

Partial view of the sewing machine showing the elements for the horizontal and vertical movements of the feed foot.

DETAILED DESCRIPTION OF THE PREFERRED EMBODIMENT

A feed cam 2, is surrounded by a cam rod 3 and fastened to the drive shaft 1 of the sewing machine. A free end of cam rod 3 is hinged to an oscillating lever 5, which has an arc-shaped slot 4. The oscillating lever 5 can be swiveled out around a mounting pin 6 formed as a rigid part of the housing of the sewing machine. For (the sake of) clarity only part 48 of the housing is shown in the drawing. A sliding block 7 is adjustably guided in the arc-shaped slot 4 relative to the mounting pin 6, and is mounted at one end of a connecting rod 8. The other end of the connecting rod 8 is hinged to a crank 9, which is fastened to the pushing shaft 10 for the lower feed dog 11 A crank 12, which is hinged to one end of the feed dog holder 13, is fastened to the pushing shaft 10. The lower feed dog 11 is bolted to the feed dog holder 13.

The pushing shaft 10 is hinged to, via crank 14, one end of a push rod 15. The other end of push rod 15 is hinged to a crank 16 and is thus connected to a needle feed oscillating shaft 17, on which the crank 16 is fastened. A needle bar 19 is fastened on a needle feed oscillating frame 18. The needle bar 19, which is movable to and fro in a known manner, carries a needle 20 at its lower end. A shuttle 21 cooperates with the needle 20 to form a seam.

A stitch length regulating lever 22, is pivotable around a mounting pin 23 forming a rigid part of the housing, and is connected by a connecting rod 24 to the connecting rod 8. The stitch length regulating lever 22 is used to change the amplitude of the oscillating movements derived from the oscillating lever 5 and thus imparted to the oscillating shafts 10 and 17.

The vertical lifting movements of the lower feed dog 11 are derived from a lifting cam 25, which is fastened on a drive shaft 26. It would also be possible to arrange the lifting cam 25 on the drive shaft 1. The lifting cam is surrounded by a cam rod 27, whose free end is adjustably connected, relative to the lifting shaft 29, to the oscillating lever 30. The adjustable connection is by means of a setscrew 31, passed through an arc-shaped slot 28 in the oscillating lever 30, fastened by a nut 32. The oscillating lever 30 is mounted freely pivotably on the lifting shaft 29.

Next to the oscillating lever 30, a lifting crank 33, which has a slot 34, is fastened on the lifting shaft 29. A follower 37 is mounted pivotably by means of a trunnion screw 38 on the lifting crank 33. The free end of the follower 37 extends into a slot 35 of a crank arm 36 of the oscillating lever 30 and is detachably fastened there by means of a screw 39. The oscillating movements imparted by the lifting cam 25 to the oscillating lever 30 via the cam rod 27 are transmitted by this coupling connection to the lifting shaft 29. The lifting shaft 29 then transmits the oscillating movements imparted by the lifting cam 25, via a lifting feed crank 40 fastened on the lifting shaft 29 and a connecting rod 41, to the feed dog holder 13.

To interrupt the lifting movements imparted to the feed dog holder 13, the screw 39 is screwed out of the crank arm 36, and the follower 37 is rotated through 180° around the trunnion screw 38. Follower 37 then engages in a slot 42 of a holder 46, which is adjustable in height by means of the screws 44 and 45 passed through a longitudinal slot 43. Holder 46 is located at a laterally spaced location from the lifting crank 33 on the machine housing, and is detachably fastened there by a screw 47. The follower 37 firmly holds the lifting shaft 29 in its turned-off position via the lifting crank 33. Unintentional displacement during the operation of the sewing machine is therefore ruled out.

To turn the lifting drive on again, it is only necessary to loosen the follower 37 in the holder 46 and to transfer the follower 37 into the slot 35 from the slot 42 around the trunnion screw 38, and to fasten the follower 37 there.

The amplitude of the lifting movement of the feed dog 11 is adjustable by adjusting the free end of the cam rod 27 after loosening the screw 31 and the nut 32 in the arc-shaped slot 28 of the oscillating lever 30.

While a specific embodiment of the invention has been shown and described in detail to illustrate the application of the principles of the invention, t will be understood that the invention may be embodied otherwise without departing from such principles.

What is claimed is:

1. An apparatus for moving a feed dog in a sewing machine having drive means for driving said sewing machine, the apparatus comprising:

a feed dog holder having a feed dog attached thereto, and having first and second ends;

horizontal oscillating means connected to said drive means and to said first end of said feed dog holder for providing horizontal oscillating movements in the feed dog;

vertical oscillating means connected to said drive means and connected to said second end of said feed dog holder for providing vertical oscillating movements in the feed dog, said vertical oscillating means including a lifting shaft and driving cam; and a detachable coupling means arranged between said lifting shaft and said driving cam for connecting and disconnecting said drive means from said feed dog holder while maintaining said feed dog holder with said feed in a horizontal plane.

2. An apparatus in accordance with the claim 1, wherein:

said vertical oscillating means also includes an oscillating crank rotatably mounted on said lifting shaft and a lifting crank rigidly mounted on said lifting shaft; and said detachable coupling means is arranged between said lifting crank and said oscillating crank.

3. An apparatus in accordance with claim 2, wherein:

said vertical oscillating means also includes a follower pivotably mounted on said lifting crank, said follower engageable in said oscillating crank in a first position and disengaged from said oscillating crank in a second position.

4. An apparatus for moving a feed dog in a sewing machine having a housing and drive means for driving said sewing machine, the apparatus comprising:

a feed dog holder having a feed dog attached thereto, and having a first and second ends;

horizontal oscillating means connected to said drive means and to said first end of said feed dog holder for providing horizontal oscillating movements in the feed dog with respect to said housing;

vertical oscillating means connected to said drive means and to said second end of said feed dog holder for providing vertical oscillating movements in the feed dog with respect to said housing, said vertical oscillating means having a lifting crank with a pivotable follower, said pivotable follower being movable to a first position enabling said vertical oscillating means to create said vertical oscillating movement from said drive means to the feed dog, and to a second fixing the feed dog at a vertical position with respect to said housing in which position said feed dog being in a active horizontal plane for moving material to be sewn without said vertical oscillating movement.

5. An apparatus in accordance with claim 4, further comprising:

a holder receiving said follower in said second position, said holder being adjustable in a location on said housing for fixing the feed dog at different vertical positions.

6. An apparatus in accordance with claim 4, wherein:

said vertical oscillating means has an adjustment means for varying amplitude of said vertical oscillating movements.

7. An apparatus for moving a feed dog in a sewing machine, the apparatus comprising: drive means for driving said sewing machine: a sewing machine housing:

a feed dog holder having first and second ends;

horizontal oscillating means connected to said drive means and to said first end of said feed dog holder for providing horizontal oscillating movements in the feed dog with respect to said sewing machine housing;

a cam rod osciliated by said drive means;

a lifting shaft;

an oscillating crank rotatably connected to said lifting shaft on a first end and rigidly fastened on a second end to said cam rod, said oscillating cam rod causing said oscillating crank to oscillate about said lifting shaft;

a lifting crank rigidly attached to said lifting shaft;

a holder mounted on said sewing machine housing;

a follower pivotably mounted on said lifting crank and engageable in a first position with said oscillating crank, causing said oscillations of said oscillating crank to oscillate said lifting shaft, and engageable in a second position with said holder for firmly fixing said lifting shaft in a fixed position; and a lifting feed crank rigidly connected on a first end to said lifting shaft and rotatably connected on a second end to said feed dog holder causing said oscillations of said lifting shaft to vertically oscillate the feed dog.

8. An apparatus in accordance with the claim 7, wherein:

said holder is adjustably mounted on said sewing machine housing for varying said fixed position of said lifting shaft.

9. An apparatus in accordance with 7, wherein:

said cam rod is adjustably mounted on said oscillating crank in order to vary amplitude of said vertical oscillation of the feed dog.

* * * * *